US007275943B2

(12) United States Patent
Ohtaka et al.

(10) Patent No.: US 7,275,943 B2
(45) Date of Patent: Oct. 2, 2007

(54) CONNECTOR FITTING STRUCTURE

(75) Inventors: Kazuto Ohtaka, Makinohara (JP); Hideki Ohsumi, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/443,071

(22) Filed: May 31, 2006

(65) Prior Publication Data

US 2006/0270258 A1 Nov. 30, 2006

(30) Foreign Application Priority Data

May 31, 2005 (JP) ..... P2005-160131

(51) Int. Cl.
*H01R 13/62* (2006.01)

(52) U.S. Cl. ..... 439/157; 439/341

(58) Field of Classification Search ..... 439/341, 439/157

See application file for complete search history.

(56) References Cited

U.S. PATENT DOCUMENTS 6,402,534 B2 * 6/2002 Okabe et al. ..... 439/157
6,623,287 B2 * 9/2003 Hatagishi et al. ..... 439/157
6,692,274 B2 * 2/2004 Maegawa ..... 439/157
6,695,631 B2 * 2/2004 Hamai et al. ..... 439/157
6,705,881 B2 * 3/2004 Tsuchiya ..... 439/157

FOREIGN PATENT DOCUMENTS

| | | |
|---|---|---|
| EP | 0 603 890 A3 | 6/1994 |
| EP | 0 607 848 A3 | 7/1994 |
| JP | 6-84566 | 3/1994 |
| JP | 2002-359028 A | 12/2002 |

* cited by examiner

*Primary Examiner*—Truc Nguyen
(74) *Attorney, Agent, or Firm*—Sughrue Mion Pllc.

(57) ABSTRACT

At a first stage of a pivotal movement of a lever, a housing-side boss slides in a fitting groove in the lever, and a fitting/disengagement projection is brought into abutting engagement with an engagement surface provided in a fitting/disengagement guide portion, and the boss is displaced to an abutment portion provided in the fitting groove. At a second stage of the pivotal movement, the lever is pivotally moved about the housing-side boss, and the fitting/disengagement projection is slid in and guided by the fitting/disengagement guide portion, so that a male connector can be completely fitted into a female connector.

10 Claims, 17 Drawing Sheets

CONNECTOR FITTING STRUCTURE

BACKGROUND OF THE INVENTION

1. Field of the Invention

This invention relates to a connector fitting structure in which a pair of female and male connectors are fitted together in a locked condition, and more particularly to the structure of a lever-type connector for effecting a fitting operation by pivotally moving a lever.

2. Related Art

Various conventional lever-type connectors are already known (see, for example, JP-A-2002-359028 Publication (Pages 5 to 6, FIGS. 2 and 3)). FIG. 17 is a cross-sectional view of a lever-type connector disclosed in Patent Literature 1, showing a condition before a male housing is fitted in a female housing, and FIG. 18 is a cross-sectional view of the lever-type connector of FIG. 17, showing a condition in which the male housing is fitted in the female housing.

Referring to FIGS. 17 and 18, in the lever-type connector 100, a projecting portion 104 of the male housing 103 is engaged in an engagement hole 102 formed in a lever 101, so that the lever 101 is supported on the male housing so as to be pivotally moved about the projecting portion 104.

The lever 101, when pivotally moved, assists in the fitting movement of the male housing 103 into a female housing 105, and brings the two housings 103 and 105 into a fitted condition. Namely, the male housing 103 is inserted and fitted into a hood portion 106 of the female housing 105, and also a retaining projection 107 of the hood portion 106 is engaged with a retaining portion (not shown) of the lever 101, so that the two housings 103 and 105 are held in the fitted condition through the lever 101.

However, in the above conventional lever-type connector 100 shown in FIGS. 17 and 18, when the lever 101 was pivotally moved so as to fit the two housings 103 and 105 together, the projecting portion 104 could not smoothly move within the engagement hole 102, thus inviting a problem that it was difficult to pivotally move the lever 101 smoothly in a stable manner. Another problem is that the radius of pivotal movement of the lever 101, as well as the force required for operating the lever, was increased.

SUMMARY OF THE INVENTION

This invention has been made in view of the above circumstances, and an object of the invention is to provide a connector fitting structure in which a lever can be smoothly operated in a stable manner, and besides a radius of pivotal movement of the lever, as well as a force required for operating the lever, can be reduced so that a connector fitting operation can be effected easily and positively with a low insertion force by the smooth pivotal movement of the lever.

According to an aspect of the invention, there is provided a connector fitting structure comprising:

a first connector;

a second connector connected with the first connector; and a lever rotatably attached to the first connector through a pivoting mechanism;

wherein, when the first connector is coupled to the second connector, a guiding mechanism is formed between the lever and the second connector;

when the lever is rotated in a first direction, the first connector is forced in a fitting direction toward the second connector by the lever through the pivoting mechanism, and the second connector is forced in a fitting direction toward the first connector by the lever through the guiding mechanism, whereby the first connector and the second connector are fitted to each other.

2) The pivoting mechanism may include a boss projected on a side surface in one of the first connector and the lever, and a fitting groove which is formed in the other of the first connector and the lever and in which the boss is slidably inserted.

3) The guiding mechanism may include a projection formed in one of the lever and the second connector, and a guide portion having a pair of engagement surfaces opposed each other between which the projection is guided in the other of the lever and the second connector.

4) When the lever is rotated in a second direction, it is preferable that the first connector is forced in a disengagement direction from the second connector by the lever through the pivoting mechanism, and the second connector is forced in a disengagement direction from the first connector by the lever through the guiding mechanism, whereby the first connector and the second connector are disengageable.

5) According to an aspect of the invention, there is provided a connector fitting structure:

a first connector having a first connector housing on a side surface of which a boss is projected;

a second connector having a second connector housing which is connected to the second connector housing and on a side surface of which a guide portion is formed; and a lever having a fitting groove and a projection, and which is rotatably attached to the first connector housing by inserting the boss in the fitting groove;

wherein the projection is guided along an engagement surface in the guide portion, by rotating the lever in a first direction, the boss is engaged in the fitting groove and the projection is engaged on the engagement surface so that the first connector and the second connector are fitted to each other.

6) The guide portion further may include an abutment portion by which the projection is positioned at a predetermined position when the projection is inserted in the guide portion.

7) A guide boss may be formed in the first connector housing and a guide groove guiding the guide boss may be formed in the lever.

8) The first connector further may include a lock arm formed on another side surface thereof which is locked with a locking projection formed in the second connector housing when the first and second connectors are fitted, and the lever is locked so as to press and hold the lock arm by rotation when the first and second connectors are fitted.

9) According to the present invention, there is provided a connector fitting structure of the present invention having first and second connectors are fitted together in a locked condition; wherein a lever is mounted on a connector housing of the first connector, and can be pivotally moved about a housing-side boss formed on and projecting from the connector housing; and at a first stage, the lever is displaced to a predetermined position relative to the housing-side boss, and then at a second stage, the lever is pivotally moved about the housing-side boss serving as a pivot axis, and in accordance with this pivotal movement, the fitting of the second connector to the first connector proceeds.

In the above connector fitting structure, at the first stage, the lever is displaced to the predetermined position relative to the housing-side boss. Then, in the second stage, the lever is further pivotally moved about the housing-side boss, and in accordance with this pivotal movement, the fitting of the second connector to the first connector proceeds. Namely, at the first stage, the lever is pivotally moved to be displaced to the predetermined position relative to the housing-side boss of the first connector before the two connectors are fitted together, and also can be located at the predetermined position relative to the second connector. Then, at the second stage, the lever is pivotally moved about the housing-side boss, and by doing so, the fitting of the two connectors can proceed smoothly. Therefore, there can be obtained the connector fitting structure in which the lever can be operated smoothly in a stable manner, and besides a radius of pivotal movement of the lever, as well as a force required for operating the lever, can be reduced.

10) A connector fitting structure of the invention of the above Paragraph 9) is further characterized in that a fitting groove is formed in the lever, and a fitting/disengagement projection is formed on and projects from the lever; and the fitting groove is slidably fitted on the housing-side boss, and guides a sliding movement of the housing-side boss in the fitting groove in accordance with the pivotal movement of the lever, thereby causing the housing-side boss to function as the axis of pivotal movement of the lever; and the fitting/disengagement projection is fitted in a fitting/disengagement guide portion provided at a connector housing of the second connector, and the fitting/disengagement projection is slid in and guided by the fitting/disengagement guide portion in accordance with the pivotal movement of the lever, so that the fitting/disengagement projection functions as a portion for guiding the fitting of the second connector to the first connector; and at the first stage of the pivotal movement of the lever, the housing-side boss slides in the fitting groove, and is displaced to an abutment portion provided in the fitting groove, and also the fitting/disengagement projection is brought into abutting engagement with an engagement surface provided in the fitting/disengagement guide portion; and at the second stage of the pivotal movement of the lever, the lever is pivotally moved about the housing-side boss, and the fitting/disengagement projection is slid in and guided by the fitting/disengagement guide portion, and also the fitting of the second connector to the first connector proceeds.

In the above connector fitting structure, the lever has the fitting groove which is slidably fitted on the housing-side boss, and guides the sliding movement of the housing-side boss in the fitting groove in accordance with the pivotal movement of the lever, thereby causing the housing-side boss to function as the axis of pivotal movement of the lever. The lever also has the fitting/disengagement projection which is fitted in the fitting/disengagement guide portion provided at the connector housing of the second connector, and the fitting/disengagement projection is slid in and guided by the fitting/disengagement guide portion in accordance with the pivotal movement of the lever. At the first stage of the pivotal movement of the lever, the housing-side boss is displaced to the abutment portion provided in the fitting groove, and also the fitting/disengagement projection is brought into abutting engagement with the engagement surface provided in the fitting/disengagement guide portion. At the second stage of the pivotal movement of the lever, the lever is pivotally moved about the housing-side boss, and the fitting/disengagement projection is slid in and guided by the fitting/disengagement guide portion, so that the fitting of the two connectors to each other can proceed smoothly. Therefore, there can be obtained the connector fitting structure in which the lever can be operated smoothly in a stable manner, and besides the radius of pivotal movement of the lever, as well as the force required for operating the lever, can be reduced.

11) A connector fitting structure of the invention according to the above Paragraph 9) or Paragraph 10) is further characterized in that the lever is a lever of a single-side construction supported on one side surface of the connector housing of the first connector.

In the above fitting structure, the lever of the single-side construction is supported on the one side surface of the connector housing, and therefore the connector housing can be formed into a compact design, and besides the construction of the lever is simple, and therefore the cost can be reduced.

In the connector fitting structure of the present invention, the lever is pivotally moved in stages, and therefore the lever can be operated smoothly in a stable manner, and besides the radius of pivotal movement of the lever, as well as the force required for operating the lever, can be reduced, and the connector fitting operation can be carried out easily and positively with the low insertion force by the smooth pivotal movement of the lever. Furthermore, the lever of the single-side construction is used, and therefore the compact design of the connector housing can be achieved, and also the cost can be reduced.

DETAILED DESCRIPTION OF THE PREFERRED EMBODIMENTS

A preferred embodiment of the present invention will now be described with reference to the drawings.

Figure 1:
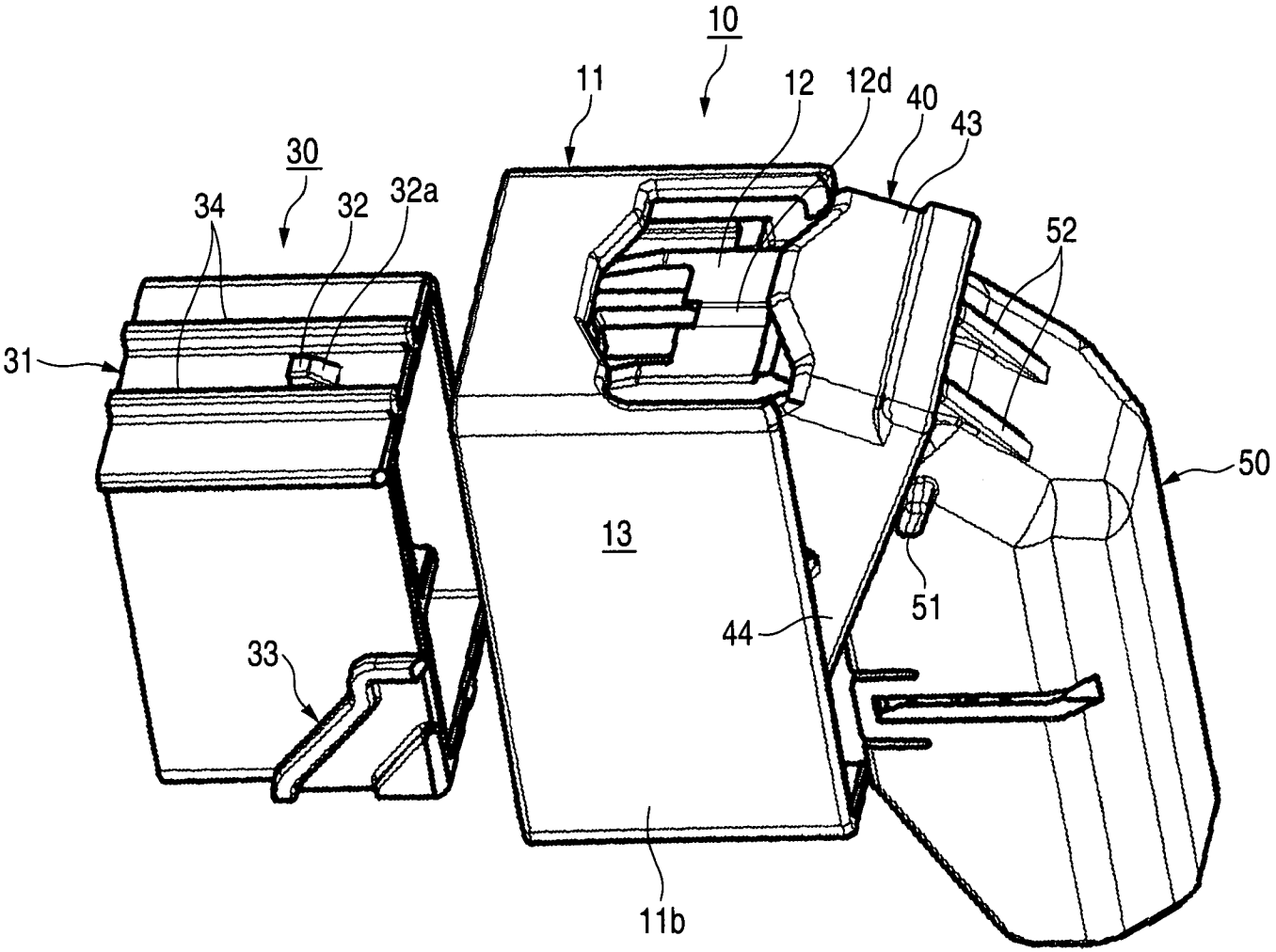
FIG. 1 is a perspective view of one preferred embodiment of a connector fitting structure of the invention, showing a condition before a male connector is fitted in a female connector.
Figure 2:
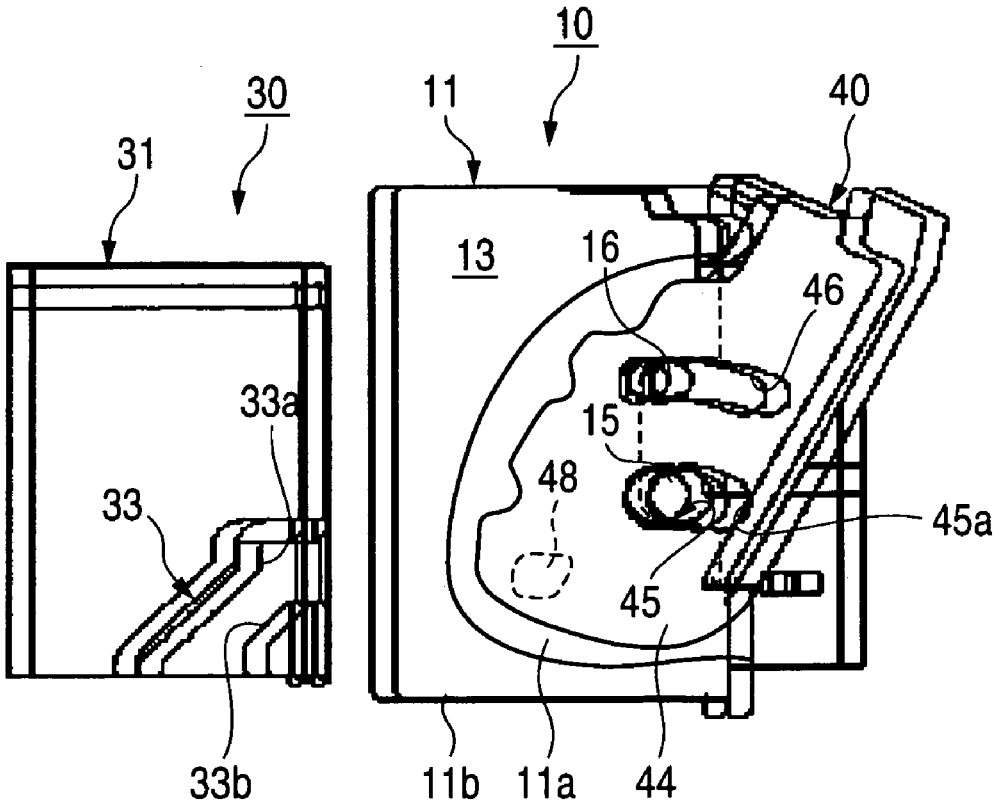
FIG. 2 is a side-elevational view of the connector fitting structure of FIG. 1, with a cover removed and also with an outer housing of the female connector partly broken.
Figure 3:
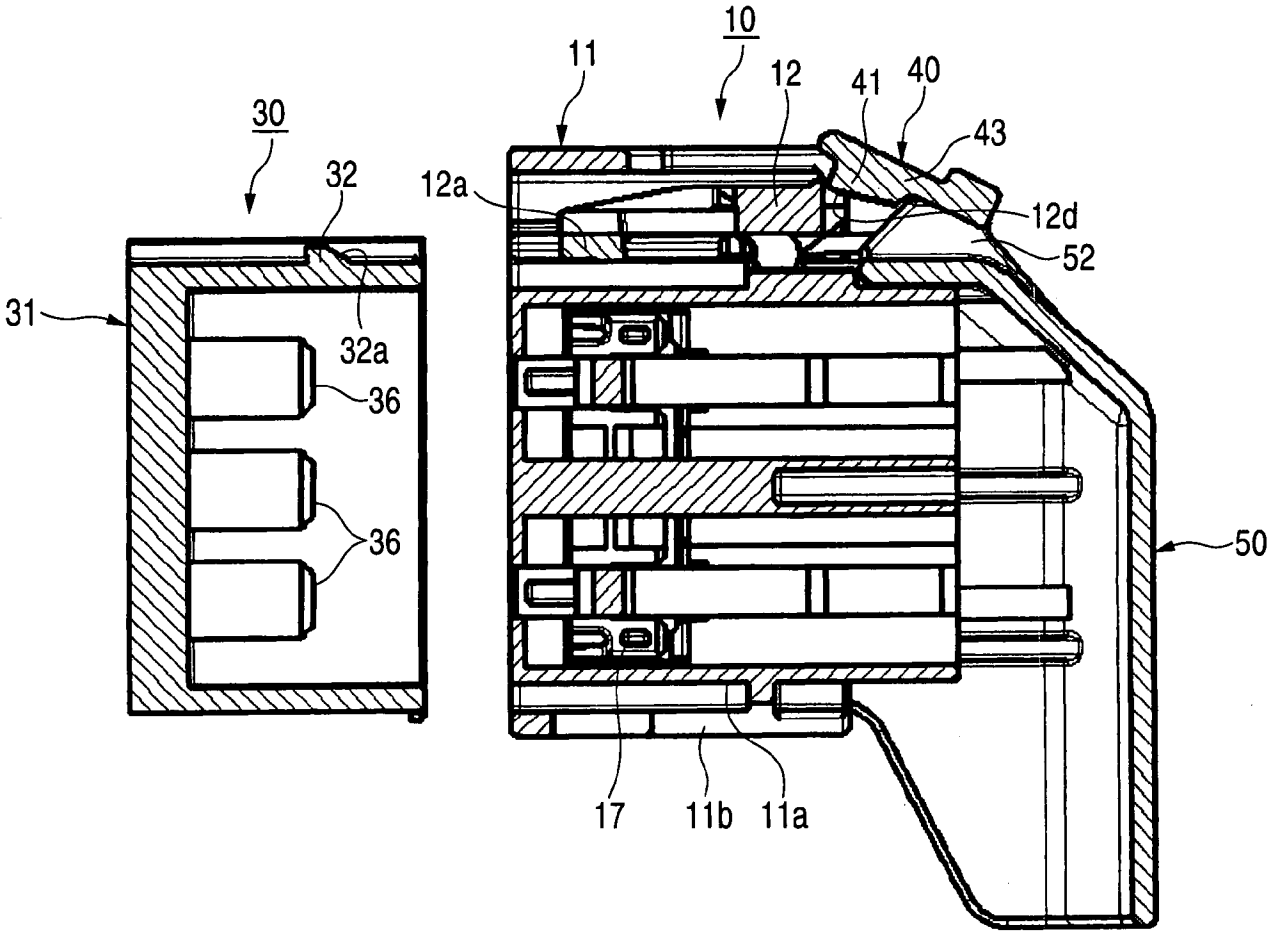
FIG. 3 is a cross-sectional view of the connector fitting structure of FIG. 1, showing a cut surface where a lock arm of the female connector can be seen.
Figure 4:
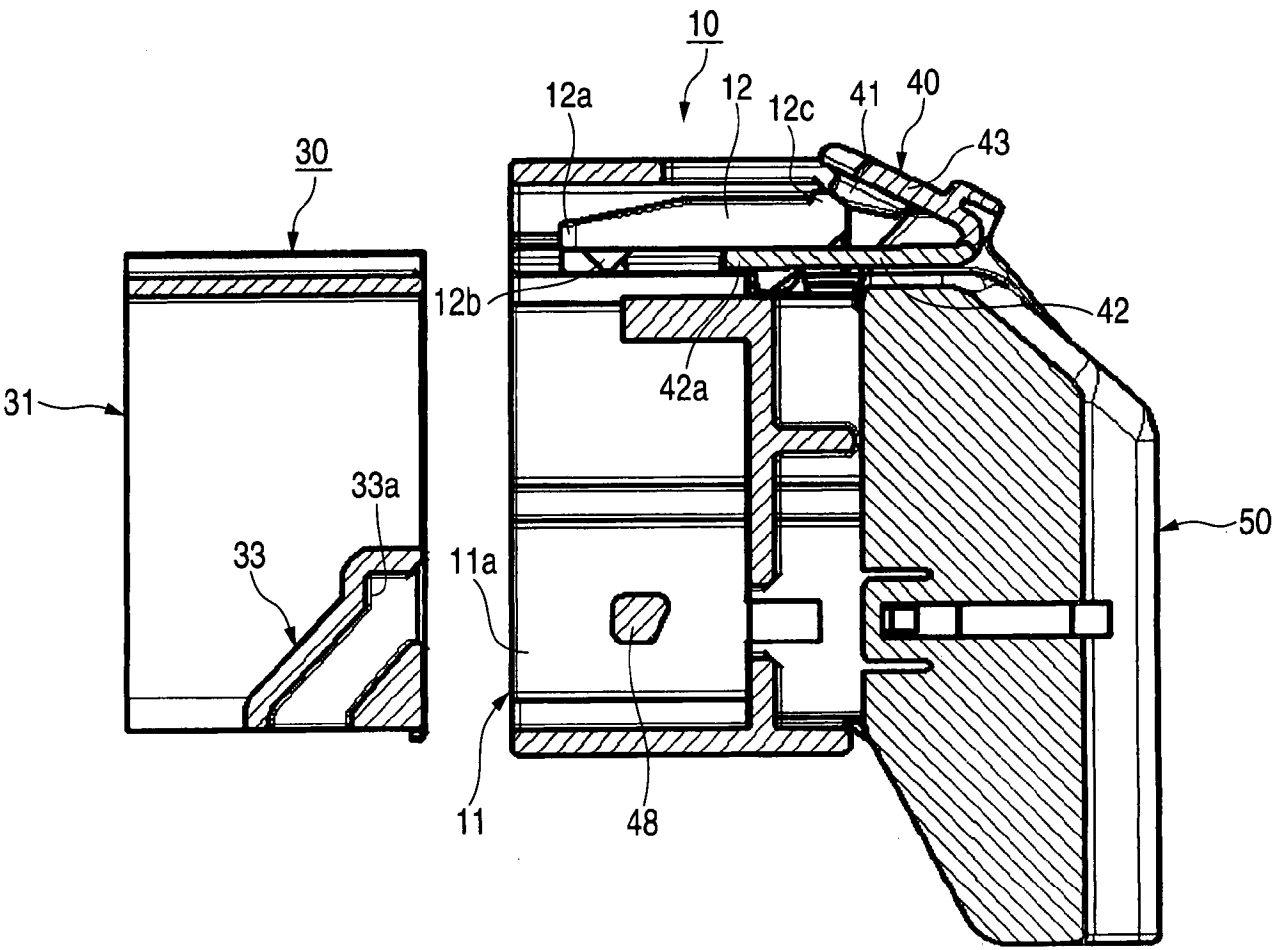
FIG. 4 is a cross-sectional view of the connector fitting structure of FIG. 1, showing a cut surface where a lock cancellation arm of a lever can be seen.

FIG. 1 is a perspective view of one preferred embodiment of a connector fitting structure of the invention, showing a condition before a male connector is fitted in a female connector, FIG. 2 is a side-elevational view of the connector fitting structure of FIG. 1, with a cover removed and also with an outer housing of the female connector partly broken, FIG. 3 is a cross-sectional view of the connector fitting structure of FIG. 1, showing a cut surface where a lock arm of the female connector can be seen, and FIG. 4 is a cross-sectional view of the connector fitting structure of FIG. 1, showing a cut surface where a lock cancellation arm of a lever can be seen.

Figure 5:
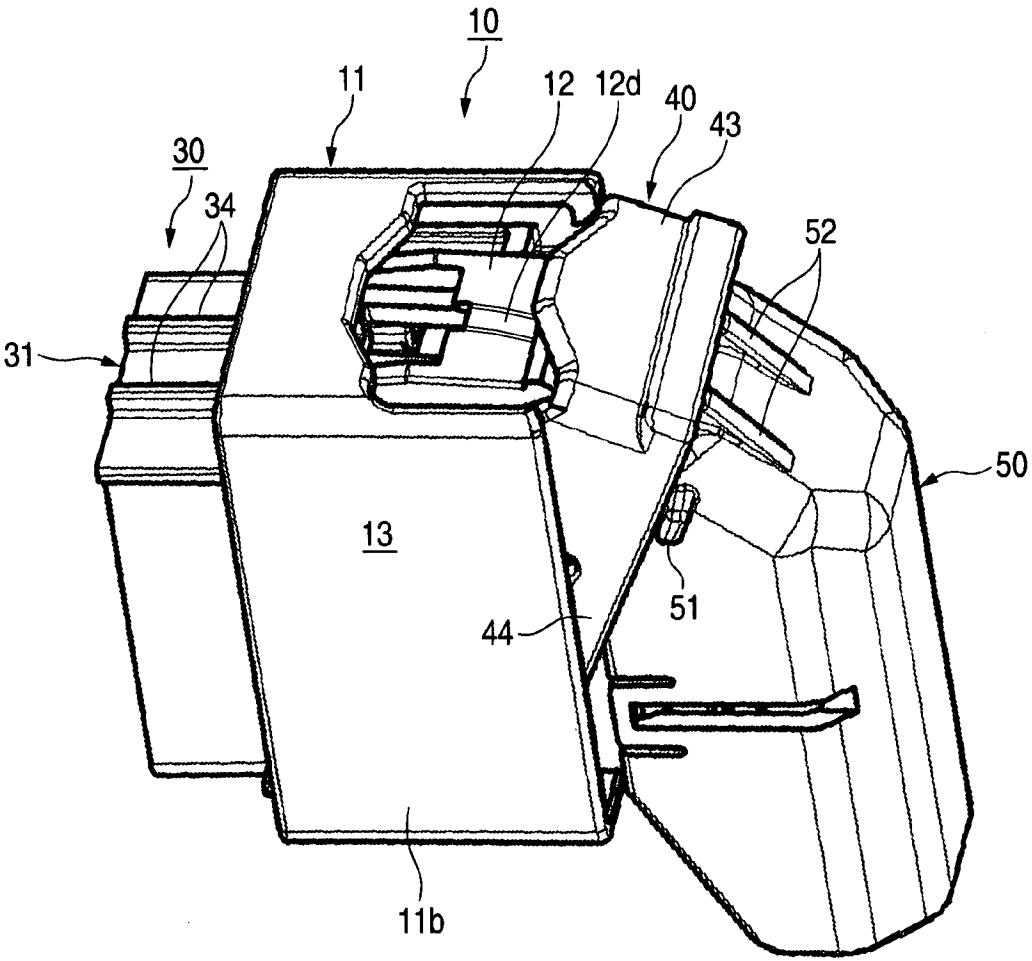
FIG. 5 is a perspective view of the connecting fitting structure of this embodiment, showing an initial stage of the fitting of the male connector into the female connector.
Figure 6:
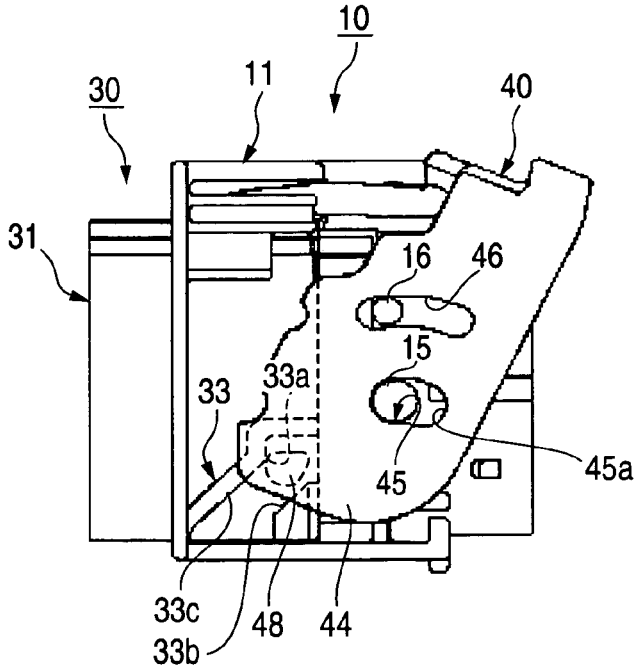
FIG. 6 is a side-elevational view of the connector fitting structure of FIG. 5 with the cover and the outer housing of the female connector housing removed, showing a condition before the lever is displaced relative to a housing-side boss.
Figure 7:
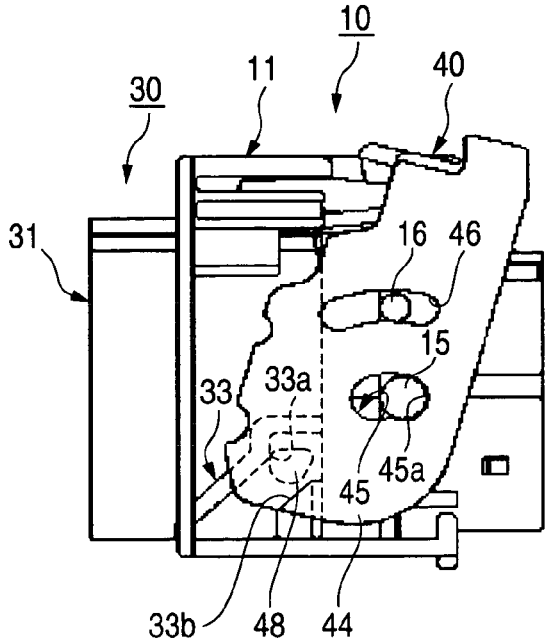
FIG. 7 is a side-elevational view of the connector fitting structure of FIG. 5 with the cover and the outer housing of the female connector housing removed, showing a condition after the lever is displaced relative to the housing-side boss.
Figure 8:
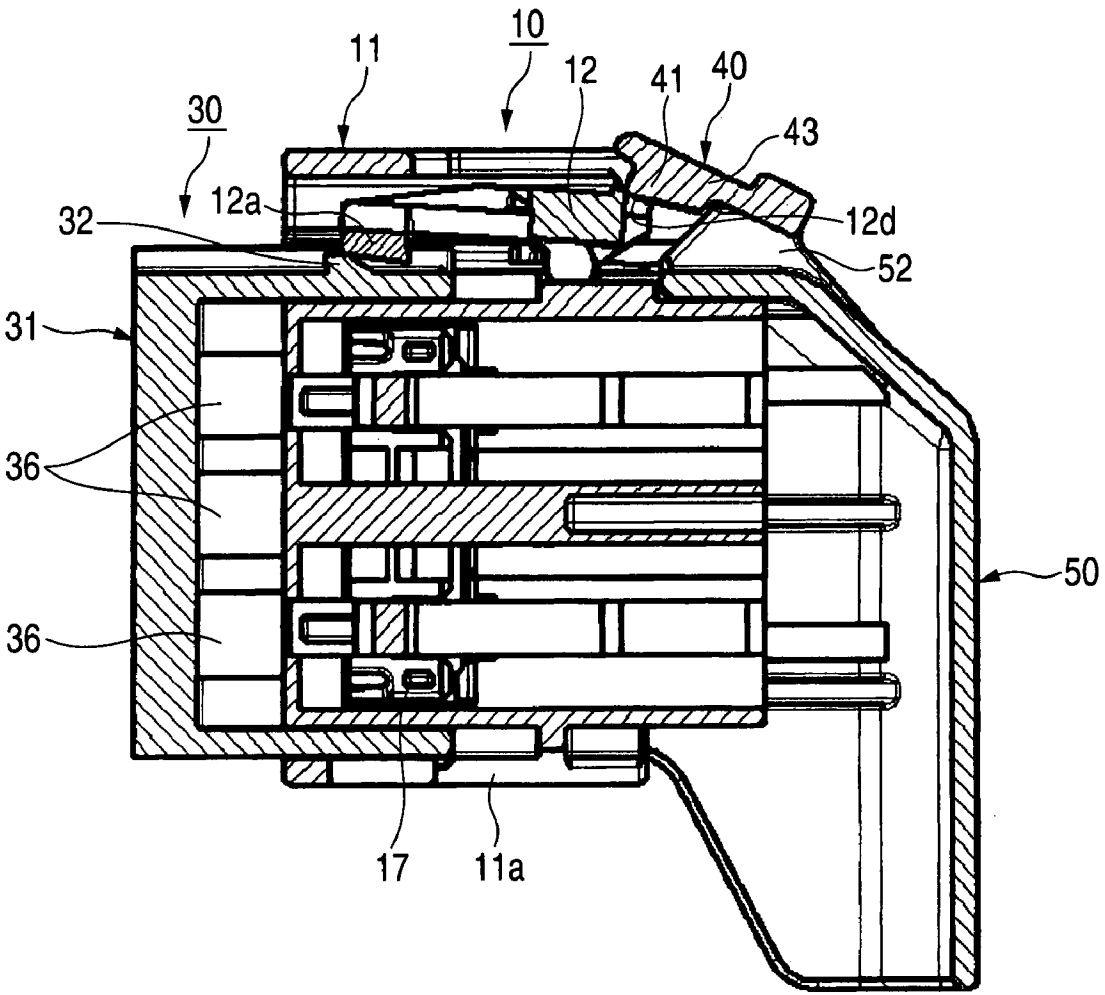
FIG. 8 is a cross-sectional view of the connector fitting structure of FIG. 5, showing a cut surface where the lock arm of the female connector can be seen.

FIG. 5 is a perspective view of the connecting fitting structure of this embodiment, showing an initial stage of the fitting of the male connector into the female connector. FIGS. 6 and 7 are side-elevational views of the connector fitting structure of FIG. 5, with the cover and the outer housing of the female connector housing removed, and FIG. 6 shows a condition before the lever is displaced relative to a housing-side boss, and FIG. 7 shows a condition after the lever is displaced relative to the housing-side boss. FIG. 8 is a cross-sectional view of the connector fitting structure of FIG. 5, showing a cut surface where the lock arm of the female connector can be seen, and FIG. 9 is a cross-sectional view of the connector fitting structure of FIG. 5, showing a cut surface where the lock cancellation arm of the lever can be seen.

Figure 9:
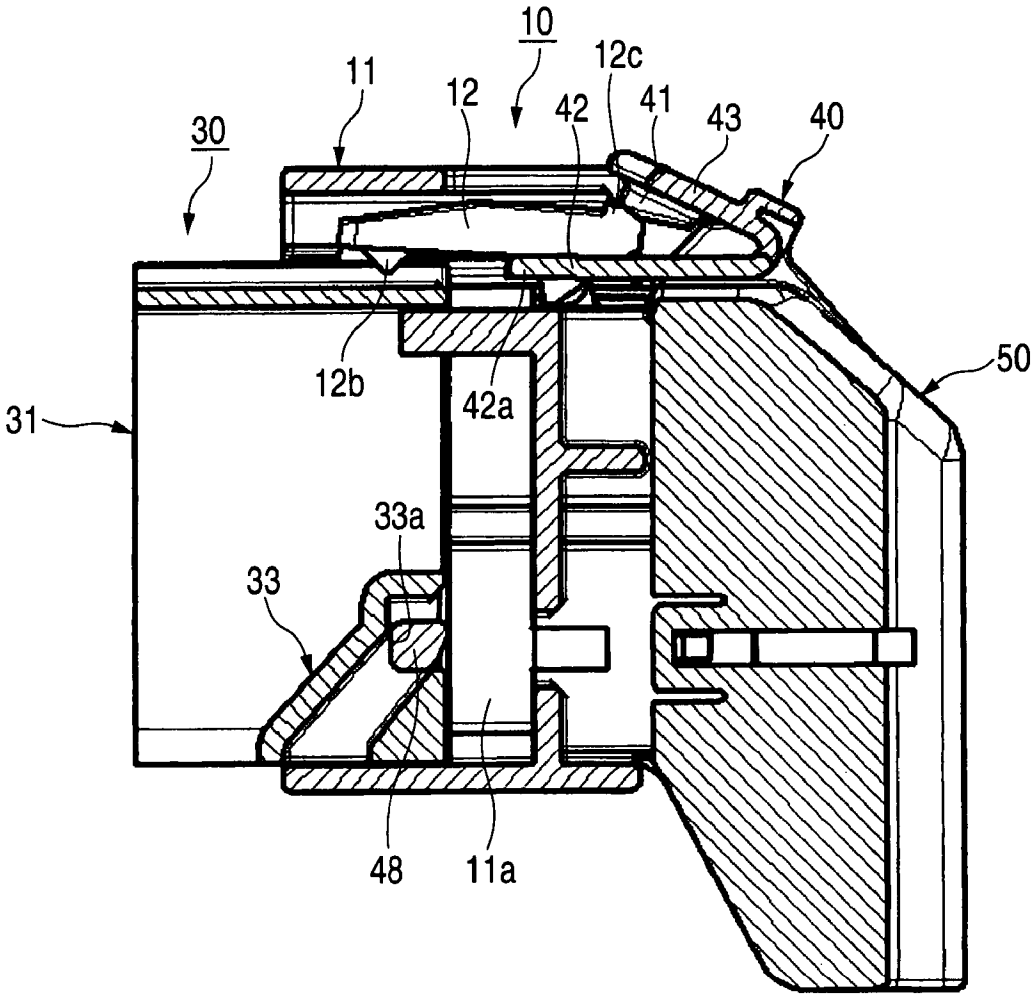
FIG. 9 is a cross-sectional view of the connector fitting structure of FIG. 5, showing a cut surface where the lock cancellation arm of the lever can be seen.
Figure 10:
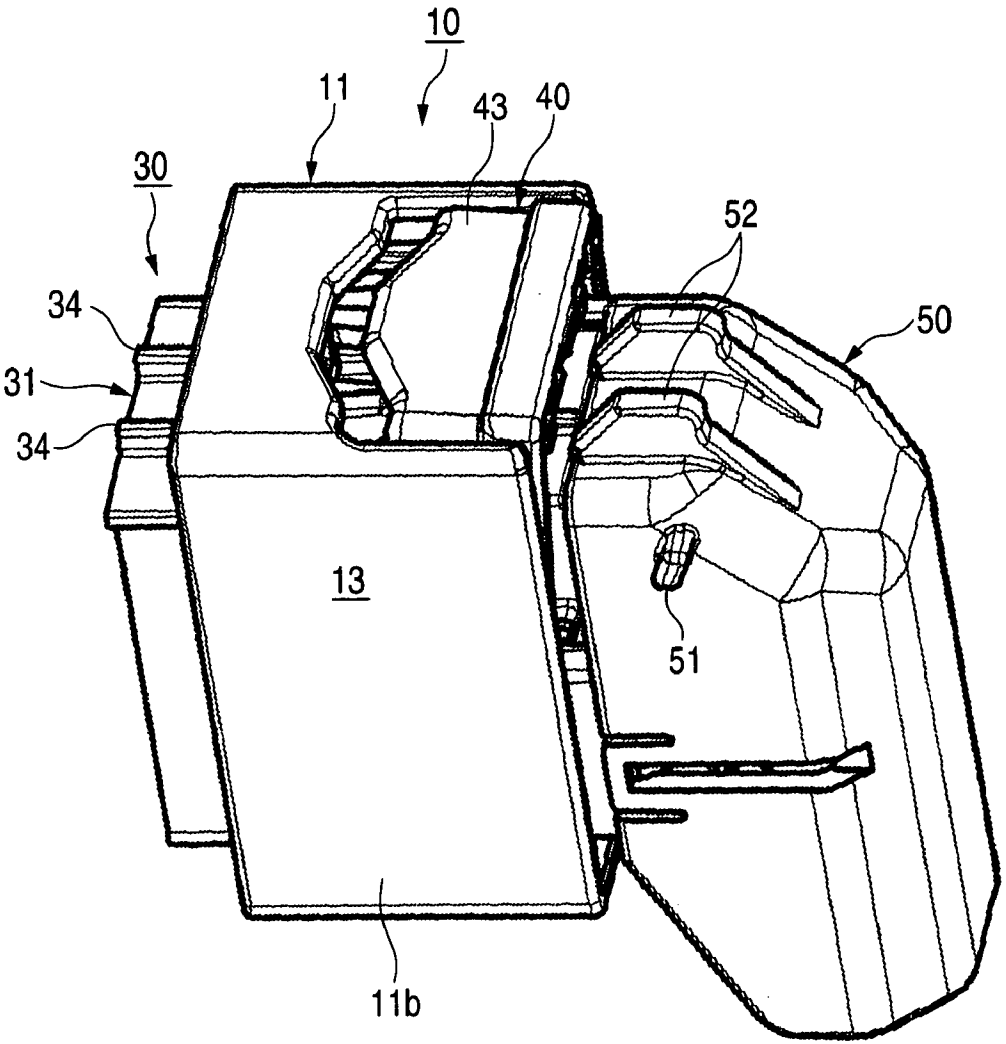
FIG. 10 is a perspective view of the connector fitting structure of this embodiment, showing a condition immediately before the male connector is completely fitted into the female connector.
Figure 11:
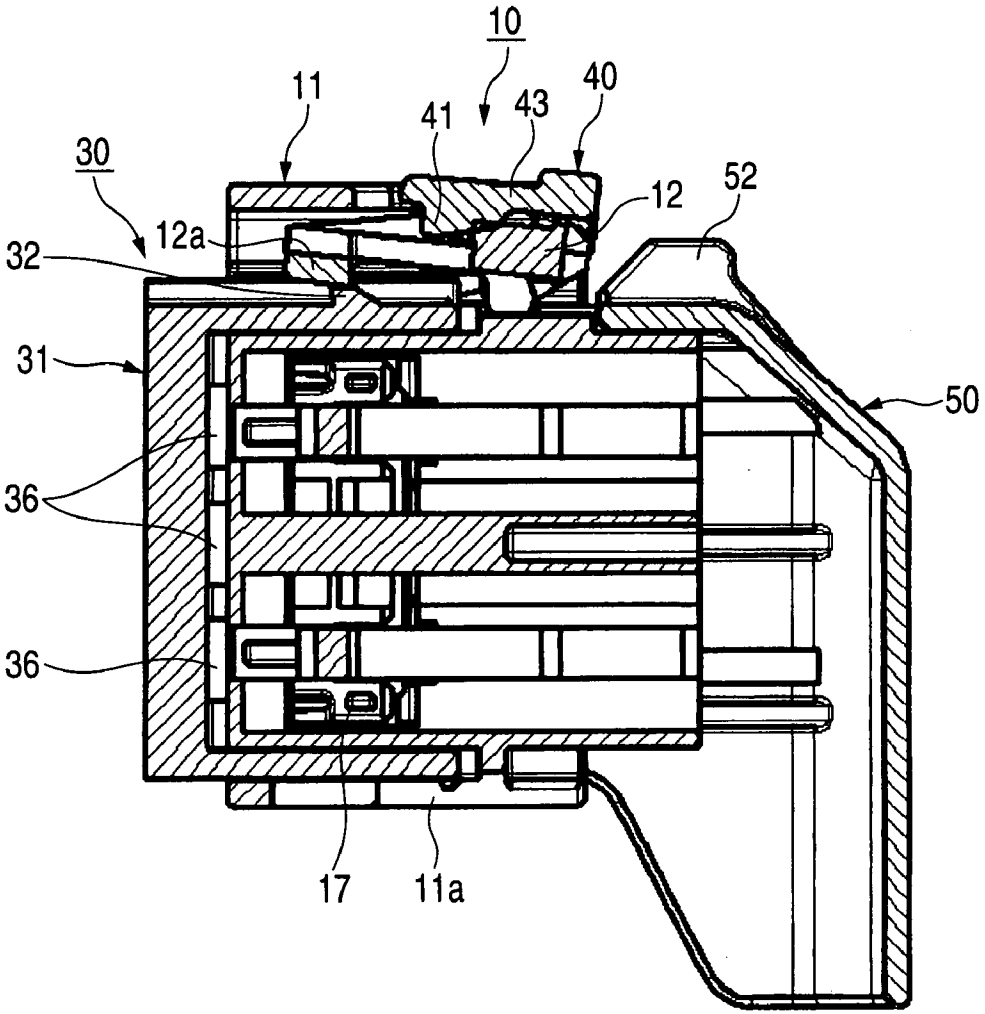
FIG. 11 is a cross-sectional view of the connector fitting structure of FIG. 9, showing a cut surface where the lock arm of the female connector can be seen.
Figure 12:
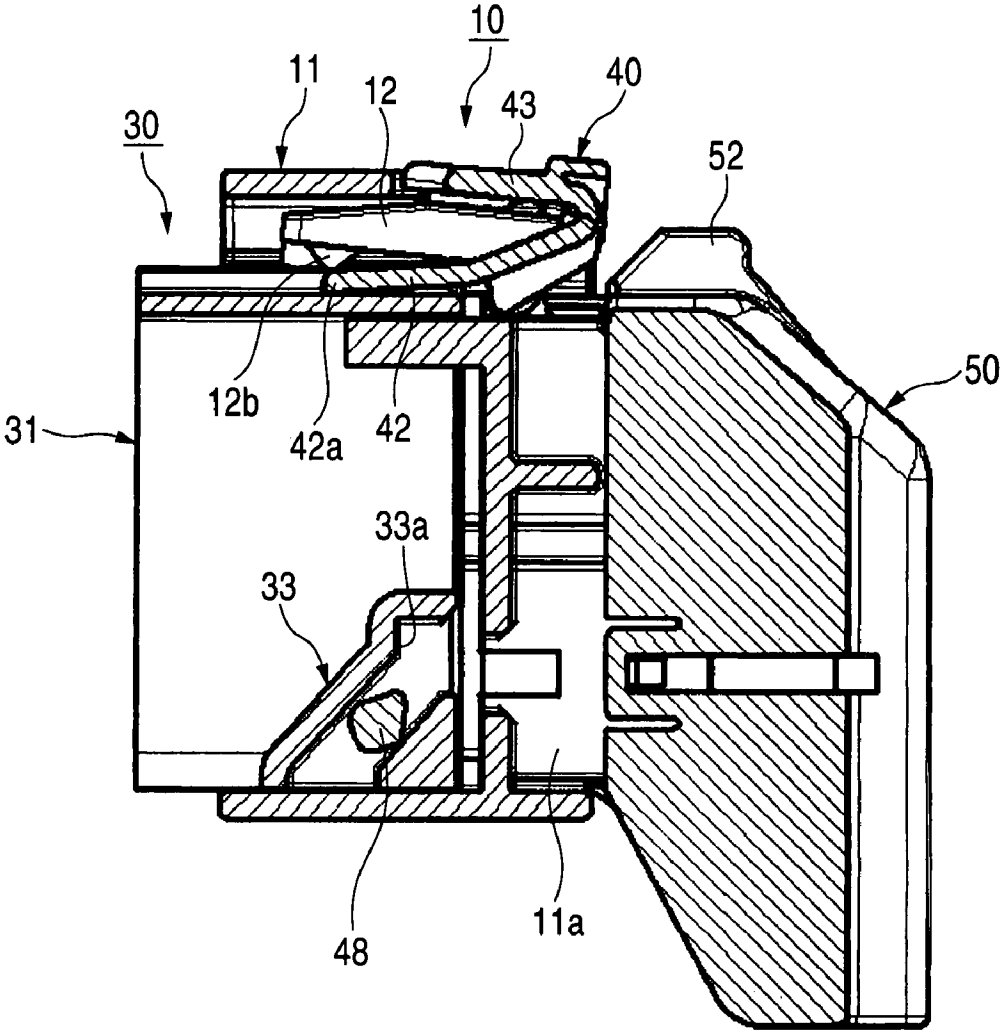
FIG. 12 is a cross-sectional view of the connector fitting structure of FIG. 9, showing a cut surface where the lock cancellation arm of the lever can be seen.

FIG. 10 is a perspective view of the connector fitting structure of this embodiment, showing a condition immediately before the male connector is completely fitted into the female connector, FIG. 11 is a cross-sectional view of the connector fitting structure of FIG. 9, showing a cut surface where the lock arm of the female connector can be seen, and FIG. 12 is a cross-sectional view of the connector fitting structure of FIG. 9, showing a cut surface where the lock cancellation arm of the lever can be seen.

Figure 13:
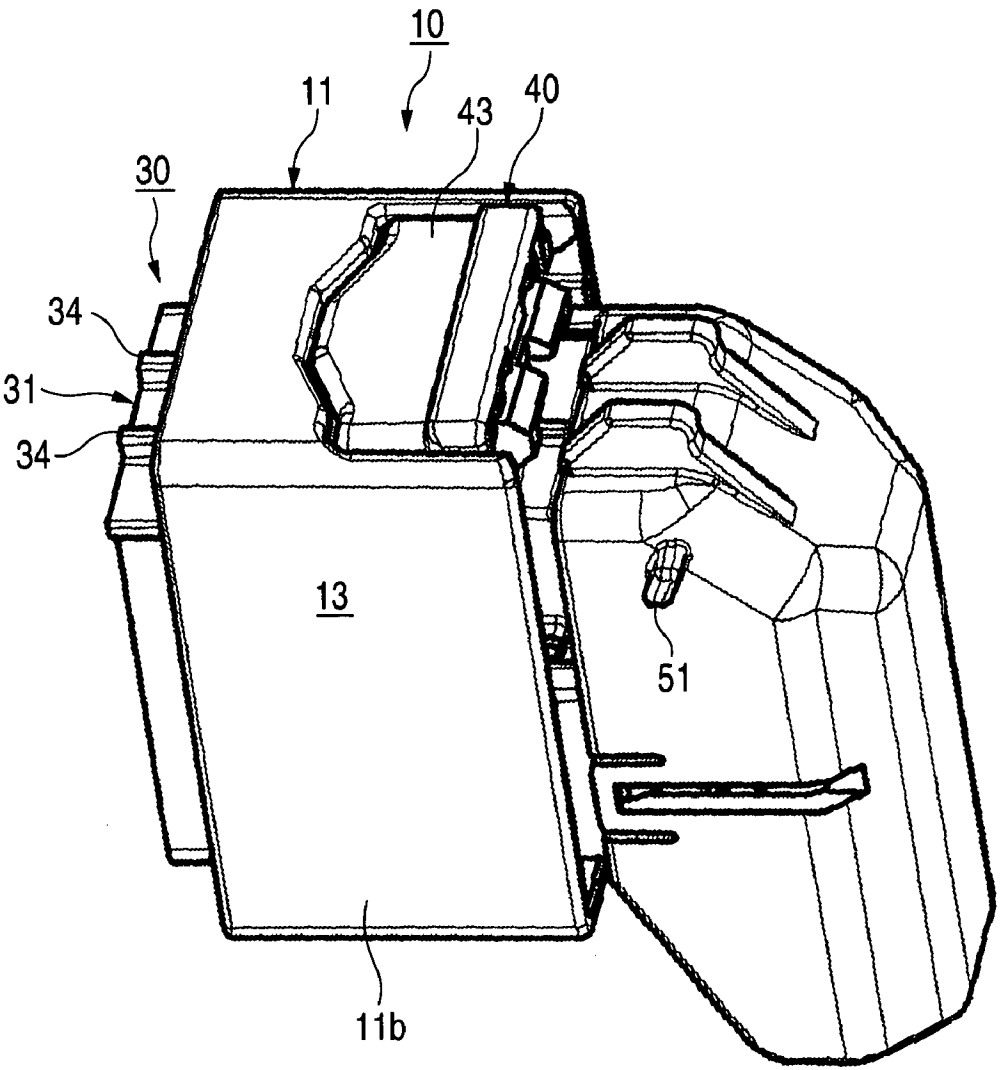
FIG. 13 is a perspective view of the connector fitting structure of this embodiment, showing a condition in which the fitting of the male connector into the female connector is completed.
Figure 14:
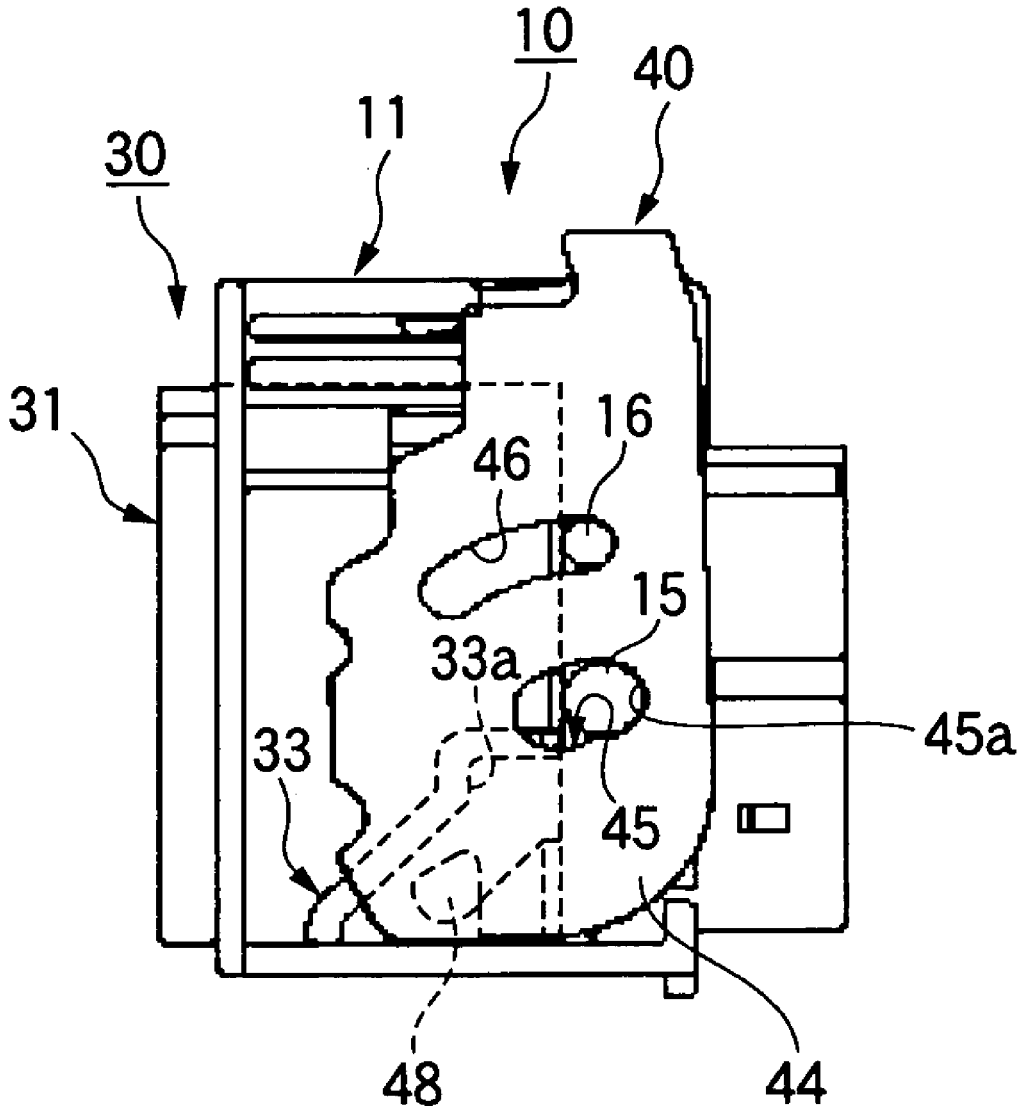
FIG. 14 is a side-elevational view of the connector fitting structure of FIG. 13, with the cover and the outer housing of the female connector housing removed.
Figure 15:
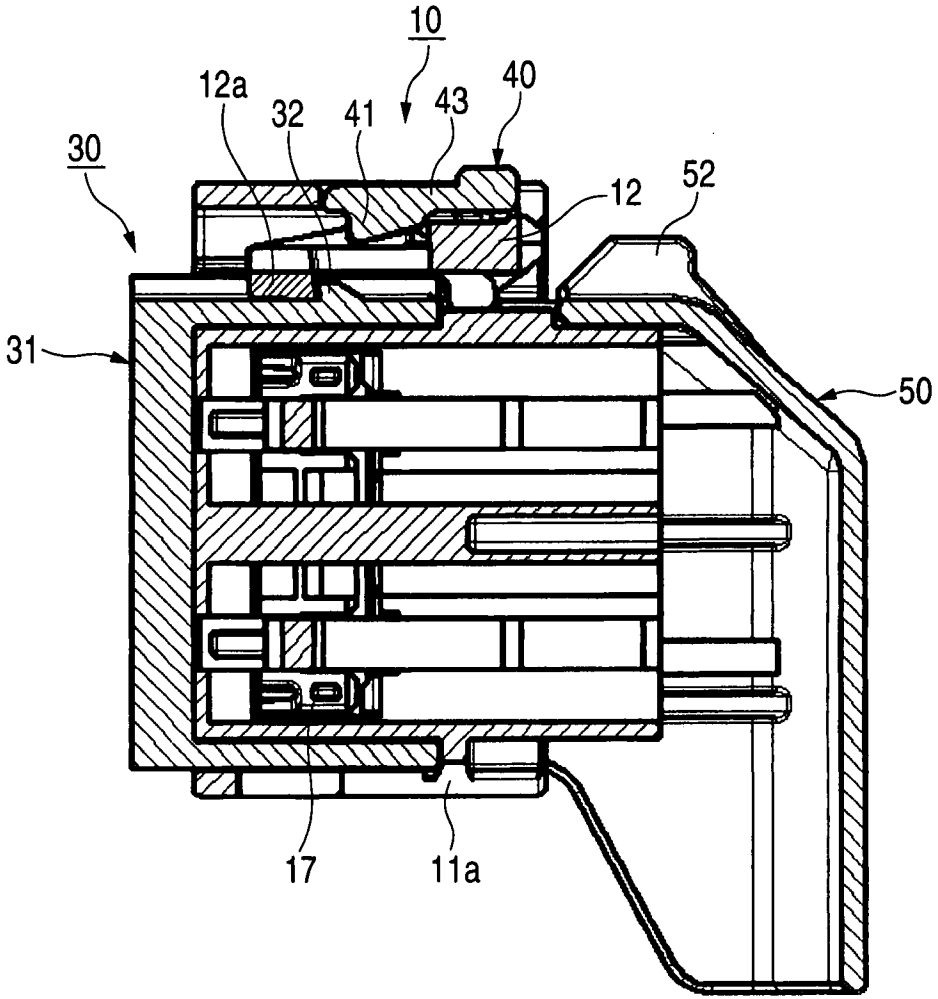
FIG. 15 is a cross-sectional view of the connector fitting structure of FIG. 13, showing a cut surface where the lock arm of the female connector can be seen.
Figure 16:
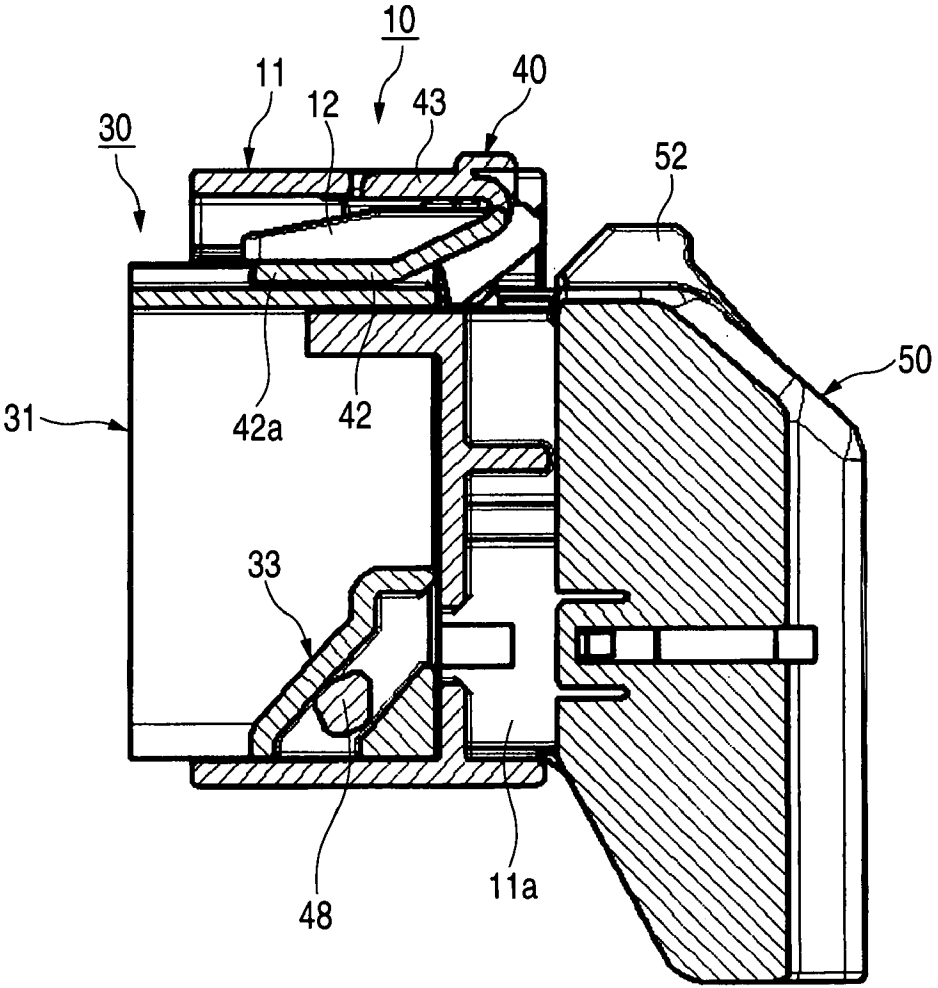
FIG. 16 is a cross-sectional view of the connector fitting structure of FIG. 13, showing a cut surface where the lock cancellation arm of the lever can be seen.
Figure 17:
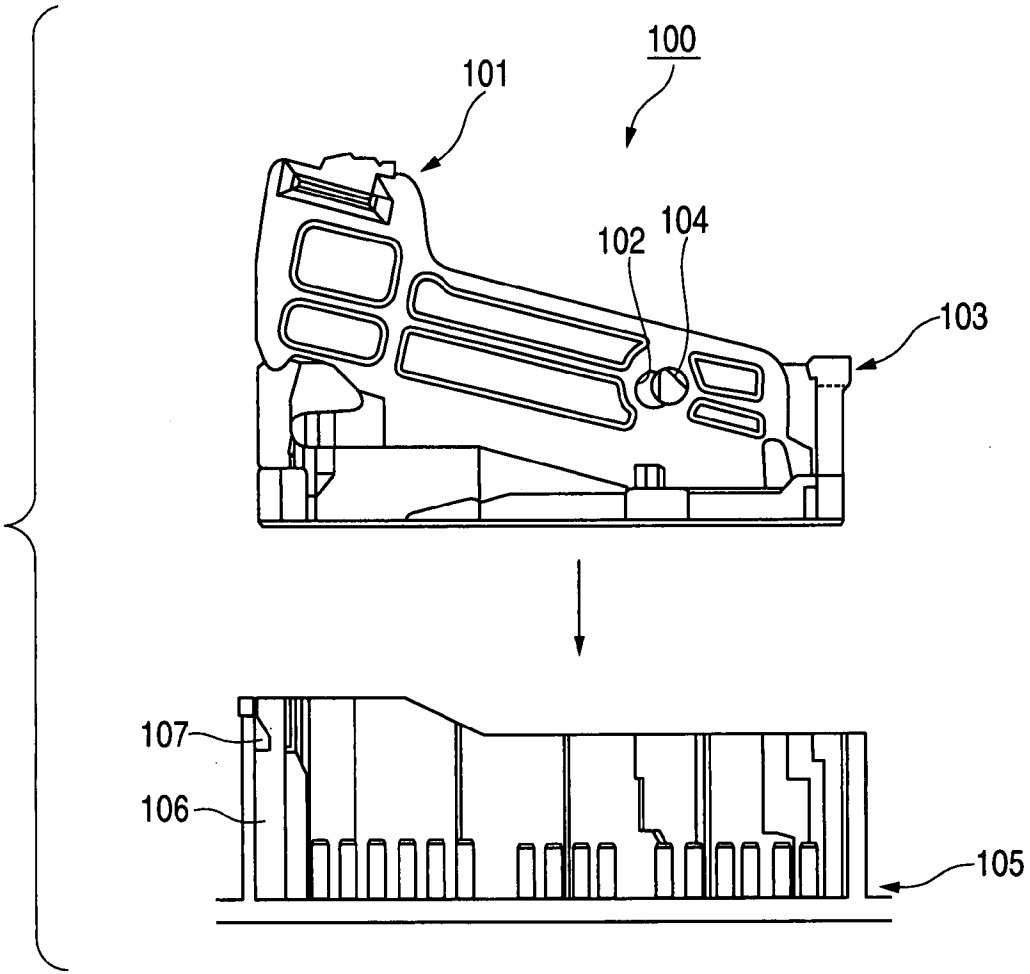
FIG. 17 is a cross-sectional view of a lever-type connector disclosed in Patent Literature 1, showing a condition before a male housing is fitted into a female housing.
Figure 18:
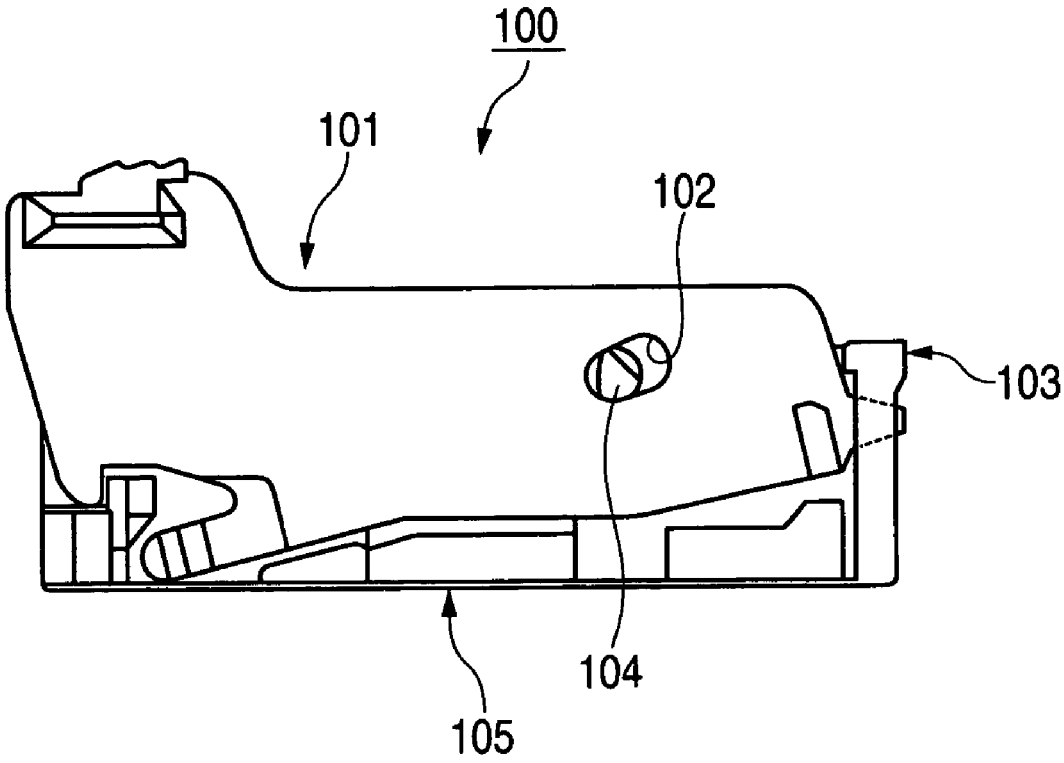
FIG. 18 is a cross-sectional view of the lever-type connector of FIG. 17, showing a condition in which the male housing is fitted in the female housing.

FIG. 13 is a perspective view of the connector fitting structure of this embodiment, showing a condition in which the fitting of the male connector into the female connector is completed, FIG. 14 is a side-elevational view of the connector fitting structure of FIG. 13, with the cover and the outer housing of the female connector housing removed, FIG. 15 is a cross-sectional view of the connector fitting structure of FIG. 13, showing a cut surface where the lock arm of the female connector can be seen, and FIG. 16 is a cross-sectional view of the connector fitting structure of FIG. 13, showing a cut surface where the lock cancellation arm of the lever can be seen.

Referring to FIGS. 1 to 16, in the connector fitting structure of this embodiment, when an engagement portion 12*a*, formed at a distal end of the lock arm 12 of the female connector 10, is engaged with an engagement projection 32 of the male connector 30, a pair of female and male connector housings 11 and 31 (of the male and female connectors 10 and 30) are fitted together in locked relation to each other. The lever 40 is pivotally mounted on the inner housing 11*a* of the female connector 10. The pivotal movement of the lever 40 in a counterclockwise direction (in FIG. 2) assists in an operation for fitting the two connector housings 11 and 31 (of the female and male connectors 10 and 30) together in the locked condition, and the pivotal movement of the lever 40 in a clockwise direction (in FIG. 2) assists in an operation for canceling the fitted/locked condition of the two connector housings 11 and 13.

When the fitted connector housings 11 and 31 of the female and male connectors 10 and 30 are locked to each other by the engagement of the engagement portion 12*a* of the lock arm 12 of the male connector 10 with the engagement projection 32 of the male connector 30, the lock arm 12 of the female connector 10 is pressed and held by the lever 40, thereby maintaining the fitted/locked condition.

The connector housing 11 of the female connector 10 includes the inner housing 11*a*, and the outer housing 11*b*, and therefore the female connector 10 has a double structure. Terminal receiving chambers are formed within the inner housing 11*a* of the female connector 10, and a plurality of female terminals are received in these terminal receiving chambers, respectively. The lock arm 12 is formed on an outer surface (upper surface in FIGS. 1 and 2) of the inner housing 11*a* of the female connector 10 so as to be pivotally moved in a seesaw-like manner about an axis disposed at a generally lengthwise-central portion thereof. The housing-side boss 15 (serving as a pivot axis about which the lever 40 can pivotally move) and a lever pivotal movement guide boss 16 are formed on and project from one side surface of the inner housing 11*a*. With respect to the positional relation between the housing-side boss 15 and the lever pivotal movement guide boss 16, the two bosses 15 and 16 are arranged on an imaginary line generally perpendicular to the direction of fitting of the female connector 10, and are disposed relatively near to each other.

The lock arm 12 includes the engagement portion 12*a* formed at the distal end (left end in FIG. 4) thereof, cancellation projections 12*b* formed respectively at opposite sides of the engagement portion 12*a*, a pressing portion 12*c* with which a pressing projection 41 of the lever 40 is engaged in accordance with the pivotal movement of the lever 40, and a guide groove 12*d* into which the pressing projection 41 of the lever 40 is fitted in accordance with the pivotal movement of the lever 40.

As the male connector 30 is fitted into the female connector 10, the engagement portion 12*a* of the lock arm 12 slides onto a tapering portion 32*a* of the engagement projection 32 of the male connector 30, and is engaged with this engagement projection 32 (as shown in FIGS. 8 and 11), and the engagement portion 12*a* slides past the engagement projection 32 (as shown in FIG. 15), thereby locking the fitted connectors 10 and 30 to each other.

At the time of canceling the fitted/locked condition of the connector housings 11 and 31 of the two connectors 10 and 30, hook-like portions 42*a* of the lock cancellation arms 42 of the lever 40 are engaged respectively with tapering surfaces (left surfaces in FIG. 4) of the cancellation projections 12*b* of the lock arm 12 to press the same, thereby bending the lock arm 12 in a manner to raise the engagement portion 12*a*.

At the time of achieving the fitted/locked condition of the connector housings 11 and 31 of the two connectors 10 and 30 and also at the time of canceling this fitted/locked condition, the pressing projection 41 of the lever 40 is engaged with the pressing portion 12*c* of the lock arm 12 to press the same, thereby bending the lock arm 12 in a manner to raise the engagement portion 12*a*.

At the time of achieving the fitted/locked condition of the connector housings 11 and 31 of the two connectors 10 and 30 and also at the time of canceling this fitted/locked condition, the guide groove 12*d* of the lock arm 12 receives the pressing projection 41 of the lever 40, thereby guiding the pivotal movement of the lever 40 relative to the lock arm 12 so as to prevent the lever 40 from being twisted.

The outer housing 11*b* of the female connector 10 has a protective wall 13 disposed in the vicinity of the lock arm 12. The protective wall 13 protects the lever 40 and the lock arm 12.

In the female connector 10 of this embodiment, the lever 40 of a generally L-shape is pivotally mounted on the inner housing 11*a*. The lever 40 includes an operating portion 43 disposed above the lock arm 12, a flat plate portion 44 disposed generally perpendicularly to the operation portion 43 to form the lever 40 into a generally L-shape as a whole, and the pair of hook-like lock cancellation arms 42 of an elastic nature.

The pressing projection 41 is formed on and projects from a lower surface (facing the lock arm 12) of the operating portion 43 of the lever 40. At the time of achieving the fitted/locked condition of the connector housings 11 and 31 of the two connectors 10 and 30, the pressing projection 41 abuts against the pressing portion 12*c* of the lock arm 12, and presses this pressing portion 12*c*, thereby bending the lock arm 12 in a manner to raise the engagement portion 12*a*.

In the fitted/locked condition of the connector housings 11 and 31 of the two connectors 10 and 30, the pressing projection 41 is engaged with the upper surface of the lock arm 12 in the vicinity of the axis of pivotal movement of the lock arm 12, and is pressed against the lock arm 12 to hold the same, thereby limiting the pivotal movement of the lock arm 12. As a result, the fitted/locked condition of the connector housings 11 and 31 of the two connectors 10 and 30, achieved by the engagement of the engagement portion 12*a* of the lock arm 12 with the engagement projection 32 of the male connector 30, is maintained.

A fitting groove 45 (in which the housing-side boss 15 of the female connector 11 is fitted) and a guide groove 46 (in which the lever pivotal movement guide boss 16 of the female connector 11 is fitted) are formed in the flat plate portion 44 of the lever 40, and further a fitting/disengagement projection 48 of a convex shape is formed on an inner surface (facing the inner housing 11*a*) of the flat plate portion 44. The positional relation between the fitting groove 45 and the guide groove 46 corresponds to the above-mentioned positional relation between the housing-side boss 15 and the lever pivotal movement guide boss 16, and the fitting groove 45 and the guide groove 46 are arranged on an imaginary line generally perpendicular to the direction of fitting of the female connector 10, and are disposed relatively near to each other.

The pivoting mechanism of the invention is constituted by the housing-side boss 15 projected on a side surface in the female connector 10, and the fitting groove 45 which is formed in the lever 40 and in which the housing-side boss 15 is slidably inserted.

The housing-side boss 15, formed on and projecting from the outer surface of the inner housing 11*a* of the female connector 11, is slidably fitted in the fitting groove 45 of the lever 40. Namely, in accordance with the pivotal movement of the lever 40, the fitting groove 45 guides the sliding movement of the housing-side boss 15 therein so that the housing-side boss 15 can function as the axis (pivot point) of pivotal movement of the lever 40 relative to the inner housing 10*a* of the female connector 30.

The fitting groove 45 has an abutment portion 45*a* formed at a rear end thereof. The abutment portion 45*a* retainingly holds the housing-side boss 15 (which moves in the fitting groove 45 in accordance with the pivotal movement (described later) of the lever 40) at a predetermined position.

The lever pivotal movement guide boss 16, formed on and projecting from the outer surface of the inner housing 11*a* of the female connector 10, is slidably fitted in the guide groove 46 of the lever 40. Namely, in accordance with the pivotal movement of the lever 40, the guide groove 46 guides the sliding movement of the guide boss 16 therein, thereby defining a path of pivotal movement of the lever 40.

In accordance with the pivotal movement of the lever 40, the fitting/disengagement projection 48 is fitted into a fitting/disengagement guide portion 33 of the male connector 30 (described later), and in accordance with the pivotal movement of the lever 40, this projection 48 is slid in and guided by the fitting/disengagement guide portion 33, thereby guiding the connector housing 31 of the male connector 30 so that this connector housing 31 can be fitted on the outer periphery of the inner housing 11*a*.

Namely, with respect to the inner housing 11*a* of the female connector 10, the lever 40 is pivotally moved about the housing-side boss 15 fitted in the fitting groove 45. With respect to the connector housing 31 of the male connector 30, the fitting/disengagement projection 48 of the lever 40 slides in the fitting/disengagement guide portion 33 of the male connector 30, and the lever 40 is pivotally moved along the predetermined pivotal movement path, while guided relative to the inner housing 11*a* of the female connector 11 by the lever pivotal movement guide boss 16 fitted in the guide groove 46.

The guiding mechanism of the invention is constituted by the-fitting/disengagement projection 48 formed in the lever 40, and the fitting/disengagement guide portion 33 having engagement surfaces 33*b* and 33*c* opposed each other between which the fitting/disengagement projection 48 is guided formed in the male connector 30.

In the connector fitting structure of this embodiment, the pivotal movement of the lever 40 is divided into two stages. At the first stage, before the male connector 30 begins to be fitted into the female connector 10, the lever 40 is pivotally moved counterclockwise (in FIG. 6) from the condition of FIG. 6, and is displaced relative to the housing-side boss 15 into a predetermined position shown in FIG. 7. Then, at the second stage, the lever 40 is further pivotally moved counterclockwise about the housing-side boss 15 from the condition of FIG. 7 into a condition of FIG. 14 in which the connector fitting operation is completed.

Namely, before the male connector 30 begins to be fitted into the female connector 10, the fitting/disengagement projection 48 of the lever 40 abuts against the engagement surface 33*c* formed at a front end portion of the fitting/disengagement guide portion 33 (see FIG. 6). In this condition, when the lever 40 is pivotally moved counterclockwise about the fitting/disengagement projection 48, the housing-side boss 15 slides right (in FIG. 6) within the fitting groove 45, and is displaced to the abutment portion 45*a* formed at the rear end of the fitting groove 45, and at the same time the fitting/disengagement projection 48 abuts against the engagement surface 33*b*), so that the lever 40 is engaged with the male connector 30 (as shown in FIG. 7). At this first stage, the male connector 30 can be located at a fittable position by the fitting/disengagement projection 48.

Further, at the second stage, the lever 40 is pivotally moved counterclockwise (in FIG. 6) about the housing-side boss 15 relative to the inner housing 11*a* of the female connector 10, with the housing-side boss 15 kept displaced to the abutment portion 45*a* of the fitting groove 45 (see FIGS. 7 and 14). In accordance with the pivotal movement of the lever 40, the fitting/disengagement projection 48, while guided by the engagement surface 33*b* of the fitting/disengagement guide portion 33, slides obliquely downward to the left (in FIG. 7) along the engagement surface 33*b*. Therefore, the lever 40 can be pivotally moved smoothly in a stable manner.

It is noted that the rotational center of the lever 40 in the first stage and the rotational center of the lever 40 in the second state are located at different positions. Therefore, the total displacement of the operating portion 43 can be reduced as compared with a case where the lever is rotated about the same rotational center with respect to the male connector from the insertion of the fitting/disengagement projection to the guide portion to the fitting of the male and female connectors.

At the time of achieving the fitted/locked condition of the connector housings 11 and 31 of the two connectors 10 and 30, the hook-like portion 42*a*, formed at the distal end (left end in FIG. 4) of each lock cancellation arm 42 of the lever 40, is engaged with a right tapering surface (in FIG. 4) of the cancellation projection 12*b* of the lock arm 12 to press this cancellation projection 12*b* in accordance with the pivotal movement of the lever 40 in the counterclockwise direction (in FIG. 2), thereby bending the lock arm 12 in a manner to move the engagement portion 12*a* away from the engagement projection 32 of the male connector 30. Namely, the lock arm 12 is pressed to be bent upwardly. As a result, the fitting/locking operation, effected by the engagement portion 12*a* of the lock arm 12 of the female connector 10 and the engagement projection 32 of the male connector 30, is assisted.

Then, when the lever 40 is further pivotally moved counterclockwise (in FIG. 2), the cancellation projection 12*b* of the lock arm 12 slides over the hook-like portion 42*a*, thereby releasing the lock arm 12.

Also, at the time of canceling the fitted/locked condition of the connector housings 11 and 31 of the two connectors 10 and 30, the hook-like portion 42*a* is engaged with a left tapering surface (in FIG. 4) of the cancellation projection 12*b* of the lock arm 12 to press this cancellation projection 12*b* in accordance with the pivotal movement of the lever 40 in a clockwise direction (in FIG. 2), thereby bending the lock arm 12 in a manner to move the engagement portion 12*a* away from the engagement projection 32 of the male connector 30. Namely, the lock arm 12 is pressed to be bent upwardly. As a result, the fitting/locking cancellation operation, effected by the engagement portion 12*a* of the lock arm 12 of the female connector 10 and the engagement projection 32 of the male connector 30, is assisted.

Then, when the lever 40 is further pivotally moved clockwise (in FIG. 2), the cancellation projection 12*b* of the lock arm 12 slides over the hook-like portion 42*a*, thereby releasing the lock arm 12.

Namely, at the time of achieving the fitted/locked condition of the connector housings 11 and 31 of the two connectors 10 and 30 and also at the time of canceling this fitted/locked condition, the lock cancellation arms 42 of the lever 40 bend the lock arm 12 upwardly (in FIG. 4) in a manner to move the engagement portion 12*a* away from the engagement projection 32 of the male connector 32 in accordance with the pivotal movement of the lever 40 in the fitting/locking effecting direction and also in the fitting/locking canceling direction. By doing so, the fitting/locking operation and the fitting/locking cancellation operation, effected by the engagement portion 12*a* of the lock arm 12 of the female connector 10 and the engagement projection 32 of the male connector 30, are assisted. Therefore, the operation for fitting and locking the connector housings 11 and 31 of the two connectors 10 and 30 to each other and also the operation for canceling the fitted/locked condition of the connector housings 11 and 31 can be carried out only by pivotally moving the lever 40.

A terminal receiving chamber is formed within the connector housing 31 of the male connector 30, and a plurality of male terminals 36 are received within this terminal receiving chamber. The engagement projection 32 is formed on the upper surface (in FIG. 1) of the connector housing 31 of the male connector 30, and fitting guide ribs 34 are formed respectively at opposite sides of the engagement projection 32. The fitting/disengagement guide portion 33 is formed at a side surface (in FIG. 2) of the connector housing 31 of the male connector 30.

When the male connector 30 is fitted into the female connector 10, the engagement projection 32 is brought into engagement with the engagement portion 12*a* of the lock arm 12 so as to lock the fitted connector housings 11 and 31 of the two connector housings 10 and 30 to each other.

The fitting guide ribs 34 of the male connector 30 define a path of movement of the connector housing 31 of the male connector 30 relative to the inner housing 11*a* of the female connector 10 when the male connector 30 is fitted into the female connector 10.

The fitting/disengagement projection 48 of the lever 40 is fitted into the fitting/disengagement guide portion 33 of the male connector 30 when the male connector 30 is fitted into the female connector 10. This guide portion 33 has the engagement surface 33*b* for guiding the sliding movement of the fitting/disengagement projection 48 when the lever 40 is pivotally moved so as to effect the fitting operation. The guide portion 33 also has the engagement surface 33*c* for guiding the sliding movement of the fitting/disengagement projection 48 when the lever 40 is pivotally moved so as to effect the disengaging operation.

Further, an abutment portion 33*a* is formed at the fitting/disengagement guide portion 33. The fitting/disengagement projection 48, fitted in the fitting/disengagement guide portion 33, abuts against the abutment portion 33*a*, thereby holding the female and male connectors at the initial condition before the pivotal movement of the lever.

The cover 50 is fitted on the rear end portion of the inner housing 11*a* of the female connector 10. The cover 50 has a U-shaped cross-section, and protects wires extending from the rear end of the inner housing 11*a* of the female connector 10.

A pair of lever guide ribs 52 are formed on an upper surface (in FIG. 2) of the cover 50, and a cover-side lever stopper 51 is formed on a side surface of the cover 50.

The lever guide ribs 52 of the cover 50 guide the pivotally-moving lever 40, and therefore define the path of pivotal movement of the lever 40, thereby stabilizing the pivotal movement of the lever 40. With this construction, the operation for fitting and locking the connector housings 11 and 31 of the two connectors 10 and 30 to each other by pivotal movement of the lever 40, as well as the operation for canceling the fitted/locked condition of the connector housings 11 and 31 by pivotal movement of the lever 40, can be carried out positively.

The cover-side lever stopper 51 stops the clockwise (in FIG. 2) pivotal movement of the lever 40 at a predetermined position (see FIGS. 1 and 5).

As described above, in this embodiment, the lever 40 of the single-side construction is pivotally mounted on one side surface of the inner housing 11*a* of the female connector 10, and the fitting groove 45 is formed in the lever 40, and the fitting/disengagement projection 48 is formed on and projects from the lever 40. The fitting groove 45 is slidably fitted on the housing-side boss 15, and guides the sliding movement of the housing-side boss 15 in accordance with the pivotal movement of the lever 40, thereby causing the housing-side boss 15 to function as the axis of pivotal movement of the lever 40. The fitting/disengagement projection 48 is fitted in the fitting/disengagement guide portion 33 formed at the connector housing 31 of the male connector, and is slid in and guided by the fitting/disengagement guide portion 33 in accordance with the pivotal movement of the lever 40, and therefore functions as the guide means for bringing the male connector 30 into and out of fitting engagement with the female connector 10.

At the first stage of the pivotal movement of the lever 40 of the above construction, the housing-side boss 15 slides in the fitting groove 45, and is displaced to the abutment portion 45*a* provided in this fitting groove, and also the fitting/disengagement projection 48 abuts against the engagement surface 33*b* provided in the fitting/disengagement guide portion 33. At the second stage of the pivotal movement, the lever 40 is pivotally moved about the housing-side boss 15, and the fitting/disengagement projection 48 is slid in and guided by the fitting/disengagement guide portion 33, so that the male connector 30 can be completely fitted into the female connector 10.

Therefore, the lever 40 can be operated smoothly in a stable manner, and besides the radius of pivotal movement of the lever 40, as well as the force required for operating the lever, can be reduced. Therefore, the connector fitting operation can be carried out easily and positively with the low insertion force by the pivotal movement of the lever 40.

In the above embodiment, the pivoting mechanism of the invention is constituted by the housing-side boss 15 projected on a side surface in the female connector 10, and the fitting groove 45 which is formed in the lever 40 and in which the housing-side boss 15 is slidably inserted. Incidentally, the housing-side boss 15 may be provided in the lever 40, and the fitting groove 45 may be formed in the female connector 10.

Further, in the above embodiment, the guiding mechanism of the invention is constituted by the fitting/disengagement projection 48 formed in the lever 40, and the fitting/disengagement guide portion 33 having the engagement surfaces 33*b* and 33*c* opposed each other between which the fitting/disengagement projection 48 is guided formed in the male connector 30. The fitting/disengagement projection 48 may be formed in the male connector 30, and the fitting/disengagement guide portion 33 may be formed in the lever 40.

The connector fitting structure of the present invention can be suitably used in the case where a connector fitting operation need to be carried out with a low insertion force.

What is claimed is:

1. A connector fitting structure comprising:

a first connector;

a second connector connected with said first connector; and a lever attached to said first connector through a pivoting mechanism which allows for both pivotal movement and translational movement of the lever with respect to the first connector;

wherein, when said first connector is coupled to said second connector, a guiding mechanism is formed between said lever and said second connector;

when said lever is rotated in a first direction as a first stage, said lever moves both rotationally and translationally with respect to the first connector such that the lever and said second connector are engaged with each other through said guide mechanism, when said lever is further rotated as a second stage, said first connector is forced in a fitting direction toward said second connector by said lever through said pivoting mechanism, and said second connector is forced in a fitting direction toward said first connector by said lever through said guiding mechanism, whereby said first connector and said second connector are fitted to each other.

2. A connector fitting structure according to claim 1, wherein said pivoting mechanism includes a boss projected on a side surface in one of said first connector and said lever, and a fitting groove which is formed in the other of said first connector and said lever and in which said boss is slidably inserted.

3. A connector fitting structure according to claim 1, wherein said guiding mechanism includes a projection formed in one of said lever and said second connector, and a guide portion having a pair of engagement surfaces opposed each other between which said projection is guided in the other of said lever and said second connector.

4. A connector fitting structure according to claim 2, wherein when said lever is rotated in a second direction, said first connector is forced in a disengagement direction from said second connector by said lever through said pivoting mechanism, and said second connector is forced in a disengagement direction from said first connector by said lever through said guiding mechanism, whereby said first connector and said second connector are disengageable.

5. A connector fitting structure:

a first connector having a first connector housing on a side surface of which a boss is projected;

a second connector having a second connector housing which is connected to said second connector housing and on a side surface of which a guide portion is formed; and a lever having a fitting groove and a projection, and which is rotatably attached to said first connector housing by inserting said boss in said fitting groove;

wherein when said lever is rotated in a first direction as a first stage, said projection is guided along an engagement surface in said guide portion so that said lever and said second connector are engaged with each other through said guide mechanism, by further rotating said lever as a second stage, said boss is engaged in said fitting groove and said projection is engaged on said engagement surface so that said first connector and said second connector are fitted to each other, wherein said boss moves translationally in said fitting groove during one of the first and second stages.

6. A connector fitting structure according to claim 5, wherein said guide portion further includes an abutment portion by which said projection is positioned at a predetermined position when said projection is inserted in said guide portion.

7. A connector fitting structure according to claim 5, wherein a guide boss is formed in said first connector housing and a guide groove guiding said guide boss is formed in said lever.

8. A connector fitting structure according to claim 5, wherein said first connector further includes a lock arm formed on another side surface thereof which is locked with a locking projection formed in said second connector housing when said first and second connectors are fitted, and said lever is locked so as to press and hold said lock arm by rotation when said first and second connectors are fitted.

9. A connector fitting structure comprising first and second connectors fitted together in a locked condition, wherein a lever is mounted on a connector housing of said first connector, and can be pivotally moved about a housing-side boss projecting from said connector housing; and at a first stage, said lever is displaced to a predetermined position relative to said housing-side boss, and at a second stage, said lever is pivotally moved about said housing-side boss serving as a pivot axis, and in accordance with pivotal movement of said lever, fitting of said second connector to said first connector proceeds, wherein a fitting groove is formed in said lever, and a fitting/disengagement projection projects from said lever; and said fitting groove is slidably fitted on said housing-side boss, and guides a sliding movement of said housing-side boss in said fitting groove in accordance with the pivotal movement of said lever, thereby causing said housing-side boss to function as the axis of pivotal movement of said lever; and said fitting/disengagement projection is fitted in a fitting/disengagement guide portion provided at a connector housing of said second connector, and said fitting/disengagement projection is slid in and guided by said fitting/disengagement guide portion in accordance with the pivotal movement of said lever, so that said fitting/disengagement projection functions as a portion for guiding the fitting of said second connector to said first connector; and at the first stage of the pivotal movement of said lever, the housing-side boss slides in said fitting groove, and is displaced to an abutment portion provided in said fitting groove, and also said fitting/disengagement projection is brought into abutting engagement with an engagement surface provided in said fitting/disengagement guide portion; and at the second stage of the pivotal movement of said lever, said lever is pivotally moved about said housing-side boss, and said fitting/disengagement projection is slid in and guided by said fitting/disengagement guide portion, and the fining of said second connector to said first connector proceeds.

10. A connector fitting structure according to claim 9, wherein said lever is a lever of a single-side construction supported on one side surface of said connector housing of said first connector.

* * * * *